United States Patent [19]

Tauber

[11] Patent Number: 4,805,495

[45] Date of Patent: Feb. 21, 1989

[54] BOLT HEAD REFORMING TOOL

[76] Inventor: Michael J. Tauber, 1908 S. Ashland Ave., Park Ridge, Ill. 60068

[21] Appl. No.: 103,673

[22] Filed: Oct. 2, 1987

[51] Int. Cl.[4] ..... B25B 13/50; B25B 23/02; B25B 13/06

[52] U.S. Cl. ..... 81/53.2; 81/121.1; 81/124.4; 72/476

[58] Field of Search ..... 81/53.2, 441, 451, 121.1, 81/124.4, 185, DIG. 11; 72/476–479

[56] References Cited

U.S. PATENT DOCUMENTS

| | | | |
|---|---|---|---|
| 264,233 | 9/1882 | Bole | 72/479 |
| 1,798,944 | 3/1931 | Jackman . | |
| 1,941,565 | 1/1934 | Mandl . | |
| 2,121,197 | 6/1938 | Jackman . | |
| 2,767,605 | 10/1956 | Schmid | 72/479 X |
| 3,161,090 | 12/1964 | McLellan . | |
| 3,640,175 | 2/1972 | Barclay | 72/476 X |
| 3,889,557 | 6/1975 | Young . | |
| 4,503,737 | 3/1985 | DiViovanni . | |
| 4,607,547 | 8/1986 | Martus . | |
| 4,611,513 | 9/1986 | Young et al. . | |
| 4,671,141 | 6/1987 | Hanson | 81/53.2 |

FOREIGN PATENT DOCUMENTS

| | | | |
|---|---|---|---|
| 2506201 | 11/1982 | France | 81/124.4 |

*Primary Examiner*—Debra Meislin

[57] ABSTRACT

A bolt head reforming tool for extracting bolts that have had their head stripped such that they cannot be removed with a wrench. A hollow tool has a central opening which has a lower portion large enough to pass over the head of the bolt and an inner portion which is smaller than the head of the bolt such that the tool can be driven onto the head of the bolt with a hammer such that the smaller portion cuts the head of the bolt to reform it to its original position. The tool may have a staggered inside cutting edge so that as the tool is driven further onto the head of the bolt, a third inner surface also cuts the head of the bolt. The outer surface of the tool is formed such that a wrench can be connected thereto so as to turn the tool and the bolt to thus remove the head.

3 Claims, 1 Drawing Sheet

BOLT HEAD REFORMING TOOL

BACKGROUND OF THE INVENTION

1. Field of the Invention

This invention relates in general to removing tools and in particular to a tool for removing a bolt which has had its head stripped.

2. Description of the Prior Art

Various tools are known for removing bolts such as U.S. Pat. Nos. 3,161,090, 4,607,547 and 1,941,565. This application is also related to my copending application Ser. No. 060,958 entitled "Polygonal Tool For Removing Stripped Hex Head Fasteners", now U.S. Pat. No. 4,716,793.

SUMMARY OF THE INVENTION

The present invention comprises a hollow tool which has an opening which is larger than the head of the bolt which is then decreased in size such that it is smaller than the head of the bolt and which may have a third portion which is even smaller than the second portion. The tool can be driven onto the head of the bolt using the first large portion of the hole as a guide and as the tool is driven onto the head of the bolt; the second smaller portion and the third even smaller portion cut and reform the head of the bolt such that the reforming tool is nonrotatably locked to the bolt. The cutting tool after being driven onto the bolt can be turned with a wrench since it has straight outer sides to which a wrench can be engaged for turning the bolt. An even larger tool can be placed around the first cutting tool so as to obtain a greater mechanical advantage for turning the bolt. The tool is provided with a hole such that a knockout pin can be inserted into the tool after the bolt has been removed so as to remove the bolt from the tool.

The tool may be used to remove hexagonal or square-headed bolts.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DESCRIPTION OF THE PREFERRED EMBODIMENTS

Figure 1:
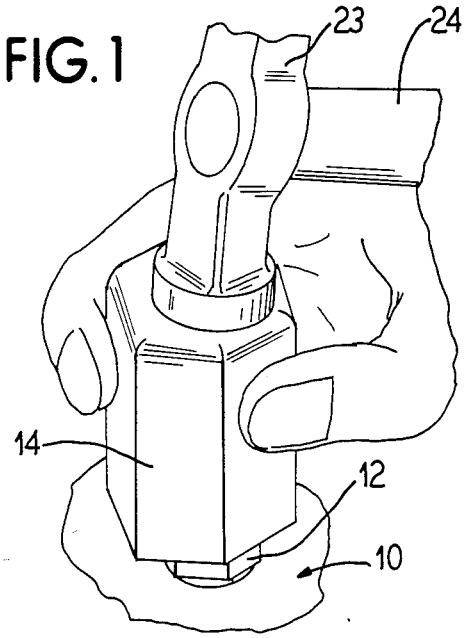
FIG. 1 is a perspective view showing the tool being driven onto a bolt.
Figure 2:
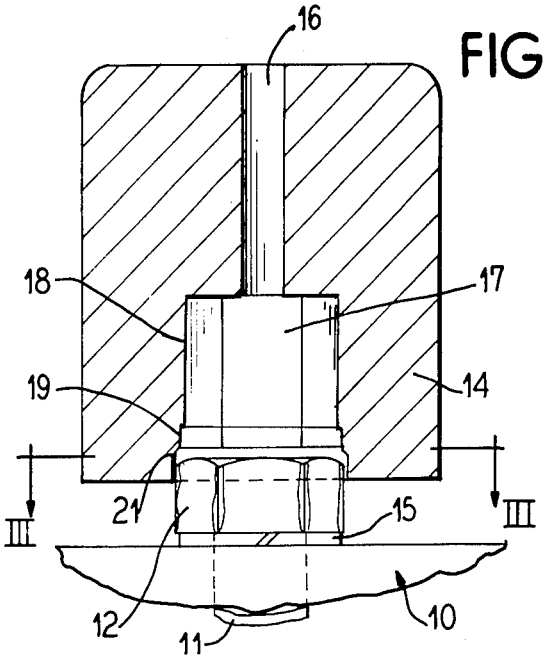
FIG. 2 is a sectional view through the tool.
Figure 3:
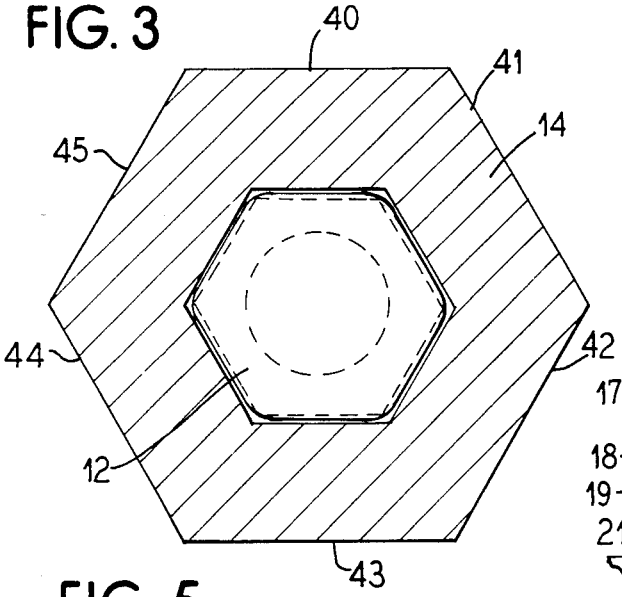
FIG. 3 is a sectional view on line III—III from FIG. 2.

FIG. 1 illustrates the bolt removing tool 14 being driven on a stripped head 12 of a bolt which is mounted in a plate 10. A hammer 23 with a handle 24 is used for driving the tool 14 onto the bolt. As shown in FIG. 2, the bolt 11 extends into the plate 10 and initially the tool 14 is placed over the head 12 which has been stripped such that an inner opening 17 of the tool 14 which has an enlarged portion 21 that serves as a guide opening can be partially placed over the head of the bolt 12. A second smaller portion 19 is formed in the opening 17 and as the tool 14 is driven down over the bolt head 12, the portion 19 cuts and reforms the shape of the head 12. A third even smaller portion 18 is formed in the opening 17 above the portion 19 so that it will further cut the upper portion of the head 12 as the tool 14 is driven on the bolt 12. In the embodiment illustrated in FIGS. 2, 3 and 4, the bolt has a hexagonal head, for example. FIG. 3 is a sectional view taken on line III—III from FIG. 2 and shows that the tool 14 has straight side 40, 41, 42, 43, 44 and 45 which are hexagonal in shape and are adapted for receiving a wrench not shown for turning the tool 14 after it has been driven onto the head 12 so as to remove the bolt 11 from the plate 10. After the bolt has been removed, a knockout pin can be inserted through a central opening 16 to remove the bolt from the tool.

Figure 4:
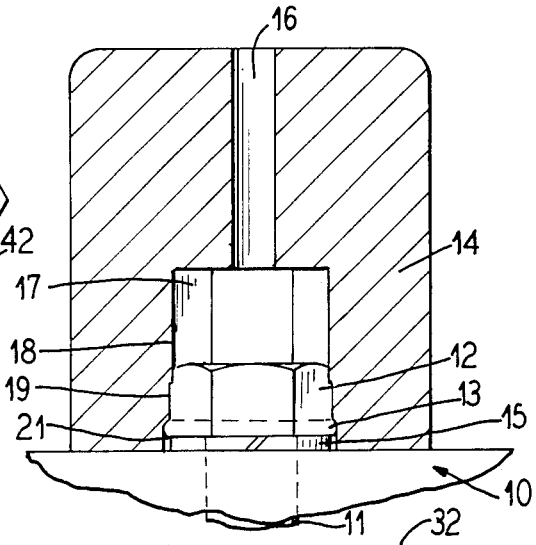
FIG. 4 is a sectional view showing the tool after it has been driven onto the head of the bolt.

The bolt head 12 in FIG. 2 clamps a washer 15 between the upper surface of the plate 10 and the lower surface of the bolt head 12. The bolt head illustrated in FIG. 4 is provided with a flange 13 adjacent the washer 15.

Figure 5:
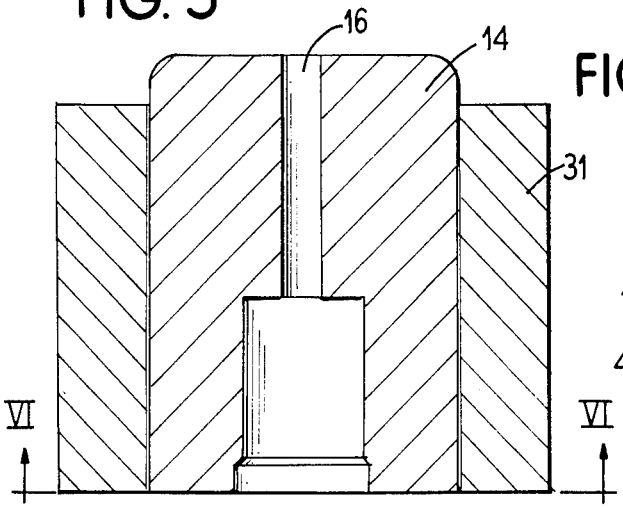
FIG. 5 illustrates an outer sleeve which has been placed around the tool.
Figure 6:
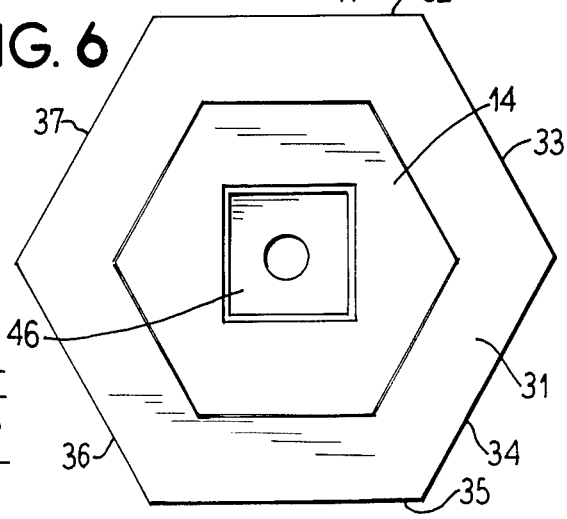
FIG. 6 is a top view illustrating tool for removing square-headed bolts.

The tools shown in FIGS. 5 and 6 are surrounded by an outer sleeve 31 which has the same configuration as the outer shape of the tool 14 and provides a mechanical advantage by providing a larger torquing surface for a wrench so as to remove the bolt after the tool 14 has been driven on the bolt head. Sleeve 31 has straight sides 32, 33, 34, 35, 36 and 37. FIG. 6 illustrates a square-headed bolt 46 which has been cut by the tool 14 by driving it thereon.

In use, the removing tool 14 is placed over the head 12 of a stripped bolt and the first portion 21 of the central opening 17 serves as a guide for aligning the tool 14 relative to the bolt head. Then the tool 14 is driven down with the hammer 23 over the bolt head 12 such that the opening 19 which is smaller than the head 12 cuts and reforms the head 12 so that straight sides are formed thereon. As the tool 14 is driven even further on to the head 12, the smaller portion 18 cuts the head even more. After the tool 14 has been drive onto the head 12 such that the lower surface of the tool is flush with the upper surface of plate 10 as shown in FIG. 4, the tool 4 can be turned with a wrench, not shown. The collar 31 can be positioned over the tool 14 to increase the leverage of a wrench or the wrench may be used to directly turn the tool 14. After the bolt has been removed, a knockout pin can be inserted into opening 16 and struck by the hammer 23 to remove the bolt from the tool.

It is seen that the present invention provides a novel bolt removing tool which can be driven onto a bolt head so that the bolt can be removed by turning the tool with a wrench and although it has been described with respect to preferred embodiments, it is not to be so limited as changes and modifications may be made therein which are within the full intended scope as defined by the appended claims.

I claim as my invention:

1. A removing tool for rotatably removing a stripped bolt having a head that has plural flat outer surfaces, but which has become stripped and cannot be turned with a normal flat-sided wrench, said tool comprising, an elongated tool body formed with an outer periphery having plural flat surfaces and formed with a central opening having plural flat sides which extend longitudinally into said tool body, said central opening comprising a polygonal guide opening extending longitudinally from a first end of said tool body to a polygonal transition opening which is longitudinally tapered and extends to a first polygonal cutting and reforming opening to form a cutting and reforming edge therewith, said guide opening being slightly larger than the head of said bolt, an impact receiving surface located on a second end of said tool body, said first cutting and reforming opening being slightly smaller than the guide opening and the head of the bolt such that when said tool body is placed over said stripped bolt head and is forcefully driven thereon said guide opening will guide said removing tool, and said cutting and removing opening will reshape said bolt head to provide it with flat sides such that said bolt can be removed by turning said tool body and said bolt head with a normal flat-sided wrench.

2. A removing tool for rotatably removing a stripped bolt according to claim 1 including a sleeve having a diameter greater than said tool body and a central opening so that it can be slidable upon said tool body, and said sleeve having an outer periphery with plural flat sides so that it can be turned by a wrench.

3. A removing tool for rotatably removing a stripped bolt according to claim 1 wherein said first cutting and reforming opening extends to a second cutting and reforming opening to further reshape said bolt head.

* * * * *